US008573983B2

(12) United States Patent
Zieder

(10) Patent No.: US 8,573,983 B2
(45) Date of Patent: Nov. 5, 2013

(54) ELECTRONIC CONNECTOR, AND CORRESPONDING ELECTRIC CONNECTION ELEMENT, ELECTRIC LINKING MEMBER, AND ASSEMBLING METHOD

(75) Inventor: David Zieder, Sciez (FR)

(73) Assignee: Nicomatic SA, Bons en Chablais (FR)

( * ) Notice: Subject to any disclaimer, the term of this patent is extended or adjusted under 35 U.S.C. 154(b) by 0 days.

(21) Appl. No.: 13/127,886

(22) PCT Filed: Nov. 9, 2009

(86) PCT No.: PCT/EP2009/064826

§ 371 (c)(1),
(2), (4) Date: May 23, 2011

(87) PCT Pub. No.: WO2010/052320

PCT Pub. Date: May 14, 2010

(65) Prior Publication Data

US 2012/0021616 A1 Jan. 26, 2012

(30) Foreign Application Priority Data

Nov. 8, 2008 (FR) ..... 08 06253

(51) Int. Cl.
*H01R 39/00* (2006.01)

(52) U.S. Cl.
USPC ..... 439/8

(58) Field of Classification Search
USPC ..... 439/1, 6, 8, 10, 31, 32, 33, 246, 247, 439/248, 249, 252, 2, 9
See application file for complete search history.

(56) References Cited

U.S. PATENT DOCUMENTS

| | | | | | |
|---|---|---|---|---|---|
| RE20,608 | E | * | 12/1937 | Koehler | 439/248 |
| 2,519,933 | A | | 8/1950 | Rouault | |
| 2,954,542 | A | * | 9/1960 | Wales | 439/252 |
| 2,999,998 | A | * | 9/1961 | Cole | 439/252 |

(Continued)

FOREIGN PATENT DOCUMENTS

| | | |
|---|---|---|
| DE | 1 067 906 | 10/1959 |
| DE | 20 2004 013 708 U1 | 12/2004 |

(Continued)

OTHER PUBLICATIONS

PCT Search Report of the ISA for PCT/EP2009/064826 dated Feb. 2, 2010.

*Primary Examiner* — Ross Gushi
(74) *Attorney, Agent, or Firm* — Daly, Crowley, Mofford & Durkee, LLP

(57) ABSTRACT

The invention relates to an electric connector that comprises a plurality of electric connection elements (7) including a first electric contact portion (13) and a second electric contact portion (15), respectively, the electric contact portion (13, 15) including a male connector (32) or a female connector. Each electric connection element (7) further includes a rigid electric linking member (17) having one end connected via a first hinge (19) to the first contact portion (13) while the other end is connected via a second hinge (21) to the second electric contact portion (15), the first electric contact portions (13) being supported in a first base (3) while the second electric contact portions (15) are supported in a second base (5). The invention further relates to a corresponding electric connection element and to an electric linking member, and to a method for assembling such a connector.

26 Claims, 4 Drawing Sheets

(56) References Cited

U.S. PATENT DOCUMENTS

Figure 4:
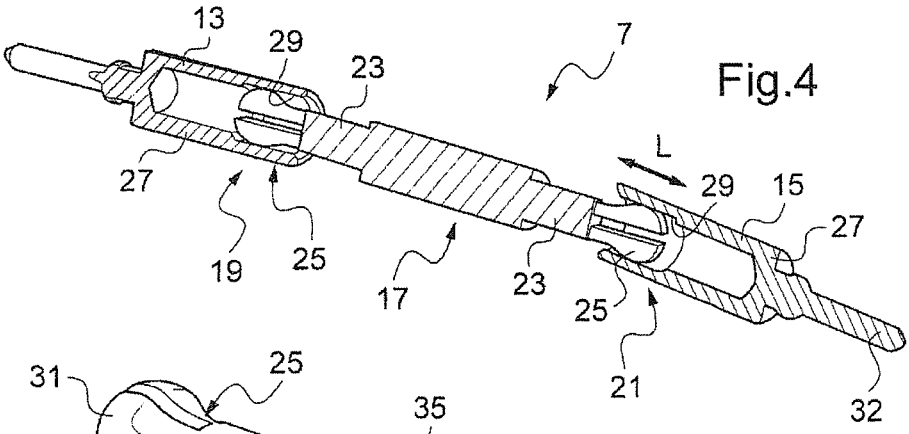

| | | | | |
|---|---|---|---|---|
| 5,647,749 | A * | 7/1997 | Atoh et al. | 439/79 |
| 5,879,177 | A * | 3/1999 | Honma | 439/246 |
| 6,224,421 | B1 * | 5/2001 | Maturo, Jr. | 439/581 |
| 6,338,631 | B1 * | 1/2002 | Hashimoto et al. | 439/79 |
| 6,341,966 | B1 * | 1/2002 | Takada et al. | 439/108 |
| 6,497,579 | B1 * | 12/2002 | Garbini | 439/63 |
| 6,773,285 | B2 * | 8/2004 | Bernat et al. | 439/246 |
| 6,908,325 | B2 * | 6/2005 | Bernat et al. | 439/246 |
| 6,976,826 | B2 * | 12/2005 | Roy et al. | 416/1 |
| 6,976,862 | B1 * | 12/2005 | Ormazabal Ocerin | 439/246 |
| 8,177,587 | B2 * | 5/2012 | Takagi et al. | 439/733.1 |
| 2002/0142625 | A1 | 10/2002 | Berghorn et al. | |
| 2004/0038586 | A1 | 2/2004 | Hall et al. | |
| 2004/0229490 | A1 | 11/2004 | Bernat et al. | |

FOREIGN PATENT DOCUMENTS

| | | |
|---|---|---|
| EP | 1 246 304 A2 | 10/2002 |
| EP | 1 249 895 A2 | 10/2002 |
| WO | WO 00/52788 | 9/2000 |

* cited by examiner

Fig.1
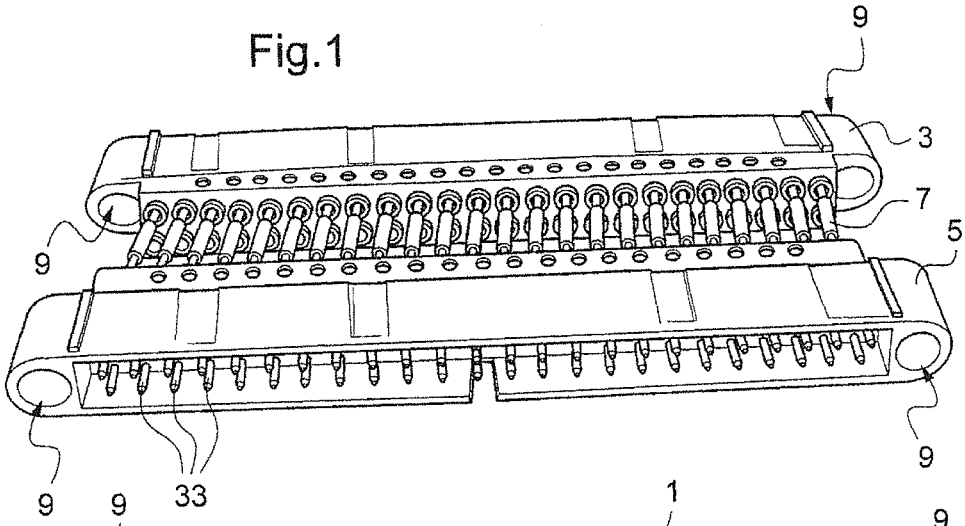
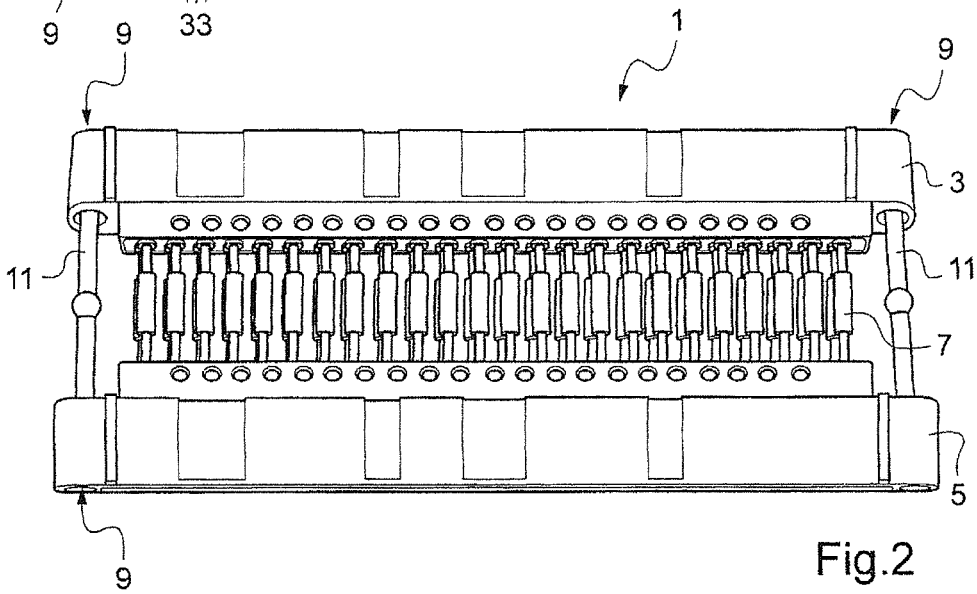
Fig.2
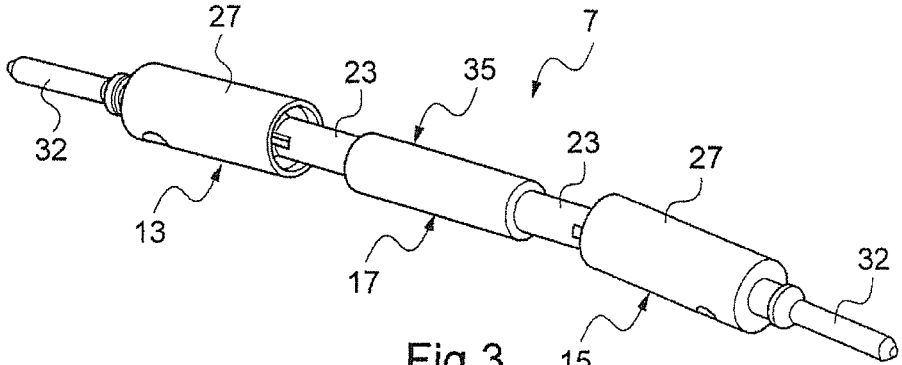
Fig.3

Fig.13
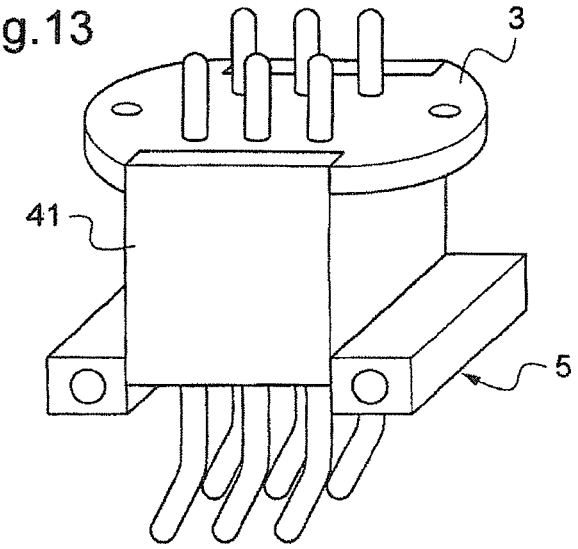
Fig.14
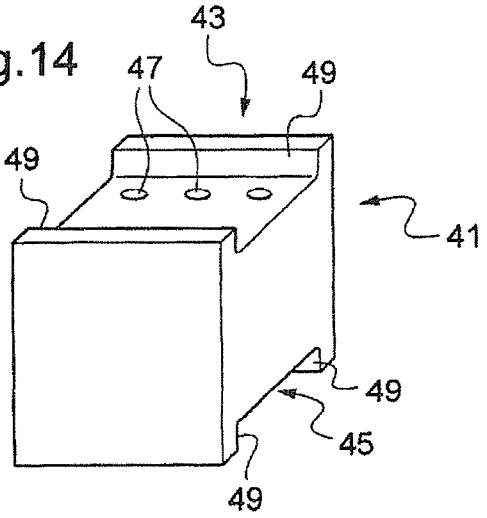
Fig.16
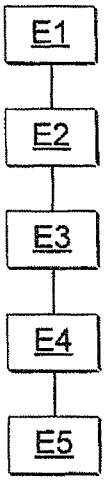
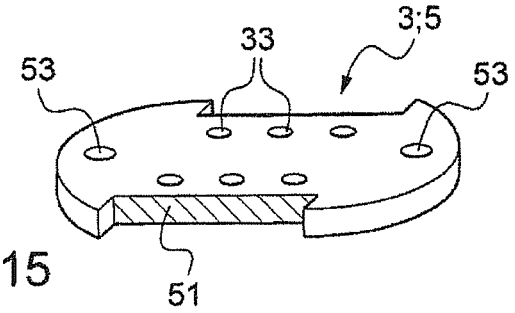
Fig.15

ELECTRONIC CONNECTOR, AND CORRESPONDING ELECTRIC CONNECTION ELEMENT, ELECTRIC LINKING MEMBER, AND ASSEMBLING METHOD

CROSS REFERENCE TO RELATED APPLICATIONS

This application is a National Stage application of PCT/EP2009/064826 filed on Nov. 9, 2009 and published in the French language, and entitled "ELECTRIC CONNECTOR, AND CORRESPONDING ELECTRIC CONNECTION ELEMENT, ELECTRIC LINKING MEMBER, AND ASSEMBLING METHOD," which claims priority to French application FR0806253 filed on Nov. 8, 2008.

The present invention relates to an electrical connector, in particular for establishing an electrical connection of a functional board in a junction rack. The invention also relates to a corresponding electrical connection element and electrical linking member, as well as to a corresponding method of assembly.

In the military sector, combat aircraft and vehicles are generally equipped with numerous electrical and electronic systems. These systems may be subjected to significant stresses in terms of vibrations and jolts when the vehicles move around in a combat zone.

In order to protect the electronic equipment and be able to ensure that it operates even under difficult conditions, it is housed on functional boards inserted into junction racks.

To provide for the electrical connections of the functional board, it is necessary to allow a slight relative movement between the board and a junction terminal while ensuring reliable electrical connection. This is why these electrical connections are effected with the aid of a harness of electrical wires or a flexible circuit one end of which is soldered to the board and the other end of which is joined to a connector of the male or female type intended to cooperate with a mating connector carried by the rack. The length of the harness or of the flexible circuit is designed to allow this relative movement between the board and an electrical junction terminal.

However, this soldering operation is irksome and lengthy, since not only is it necessary to solder all the electrical wires or electrical tracks one by one, it is also necessary however thereafter to check the quality of the soldering spots one by one.

Moreover, the dimensions in applications of this type do not make it possible to resort to wiring. Indeed, a wire-based harness or flexible cable has one rib related to the manufacturing process of significant minimum length, namely greater than 30 mm.

Moreover, when the functional board is inserted into the rack, access to the connector may be difficult or impossible.

To alleviate this drawback, it has also been proposed to envisage a connector with male contacts mounted movably in relation to their longitudinal axis and thrust by springs toward contacting spans of the junction terminal.

Indeed, the male contacts rub on the contact spans thus allowing a relative movement between the board and the junction terminal.

Now, in terms of connection security, this solution is not optimal, since in the hostile environments to which military vehicles may be subjected, significant accelerations may lead to a loss of the electrical connection. Furthermore, this solution is not robust in the presence of dust or deposits, for example of oil, which may also decrease the quality of the electrical connection of the functional board and of the components housed therein.

The present invention is aimed at proposing an electrical connector which makes it possible to circumvent, at least partially, the aforementioned drawbacks.

For this purpose, the subject of the invention is an electrical connector comprising a plurality of electrical connection elements, comprising respectively a first electrical contact part and a second electrical contact part, characterized in that each electrical connection element furthermore comprises a rigid electrical linking member one end of which is linked via a first articulation on the first contact part and the other end of which is linked via a second articulation to the second electrical contact part, and in that the first electrical contact parts are retained in a first base and in that the second electrical contact parts are retained in a second base. This electrical connector can comprise one or more of the following characteristics, taken singly or in combination:

- the articulations are effected in the form of a knuckle articulation,
- the rigid electrical linking member is formed by a rod carrying at each end a knuckle and each electrical contact part comprises an end in the form of a receptacle receiving an associated knuckle,
- the rigid electrical linking member is formed by a rod carrying at each end a receptacle and each electrical contact part comprises an end in the form of a knuckle inserted into an associated receptacle,
- the rod is bent,
- each receptacle is split so as to exert an elastic retaining force on the associated knuckle,
- each knuckle is split so as to exert an elastic retaining force inside the associated receptacle,
- the receptacle exhibits a channel for receiving an associated knuckle, the channel exhibiting a length allowing a translational movement of the knuckle inside the receptacle,
- each receptacle exhibits a constriction serving as stop for an associated knuckle,
- the electrical contact part comprises a male plug or a female socket,
- said connector comprises a block of an elastic and insulating material which shrouds the electrical linking members,
- the elastic material block is made of silicone, preferably by molding,
- said connector comprises articulated fixings between the bases,
- the bases are respectively fixed to said block,
- the block exhibits two housings for receiving respectively an associated base, said housing exhibiting a cross section of general "U"-shaped form with two lateral walls, and the associated base is fixed to the two lateral walls of said housing.

The subject of the invention is furthermore an electrical connection element for an electrical connector such as defined above, characterized in that said connection element comprises a first electrical contact part exhibiting a male plug or female socket and a second electrical contact part, and in that it furthermore comprises a rigid electrical linking member one end of which is linked via a first articulation on the first contact part and the other end of which is linked via a second articulation to the second electrical contact part.

The subject of the invention is also an electrical linking member for a connection element such as defined hereinabove, characterized in that it is formed by a rod carrying at each end a knuckle for cooperating with an associated receptacle of an electrical contact part.

The subject of the invention is furthermore an electrical linking member for a connection element such as defined hereinabove, characterized in that it is formed by a rod carrying at each end a receptacle for cooperating with an associated knuckle of an electrical contact part.

The invention also relates to a method for assembling an electrical connector, comprising the following steps:

- the first electrical contact parts are inserted into the first base,
- the second electrical contact parts are inserted into the second base,
- the electrical linking members are inserted into the elastic and insulating material block while leaving the ends of the electrical linking members free,
- the first base is mounted on said block with the first contact parts facing first ends of the electrical linking members so as to link via the first articulations the first ends of the electrical linking members on the first contact parts,
- the second base is mounted on said block with the second contact parts facing the second ends of the electrical linking members so as to link via the second articulations the second ends of the electrical linking members on the second contact parts, and
- the bases are fixed on said block.

Figure 5:
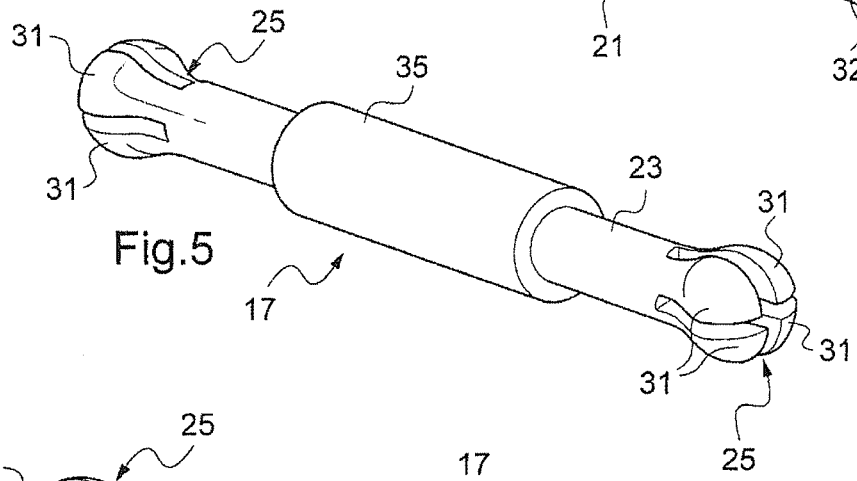
Figure 6:
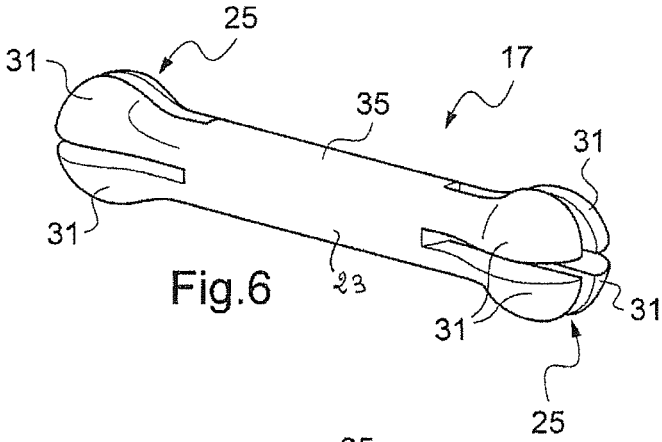
Figure 7:
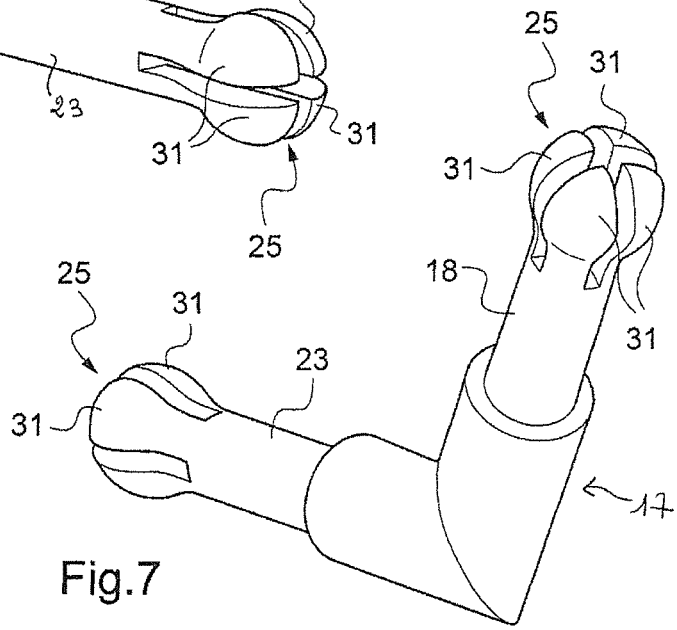
Figure 8:
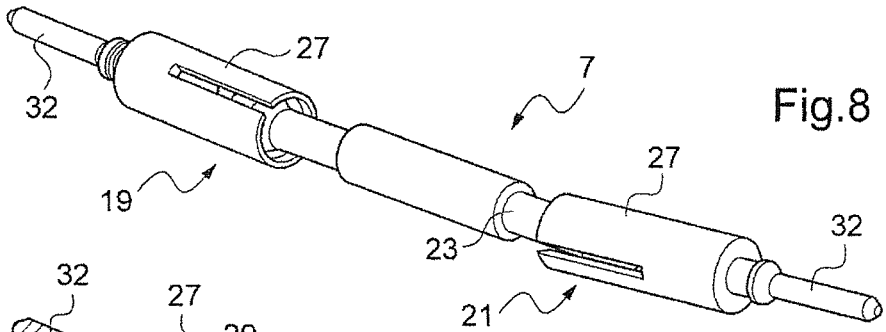
Figure 9:
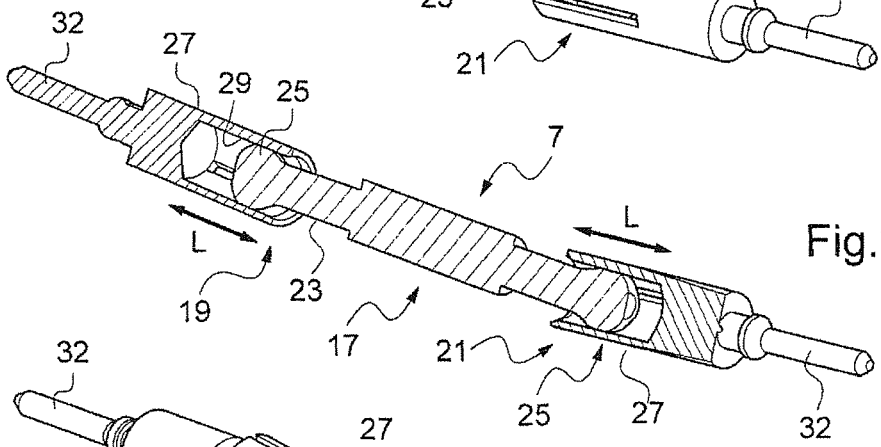
Figure 10:
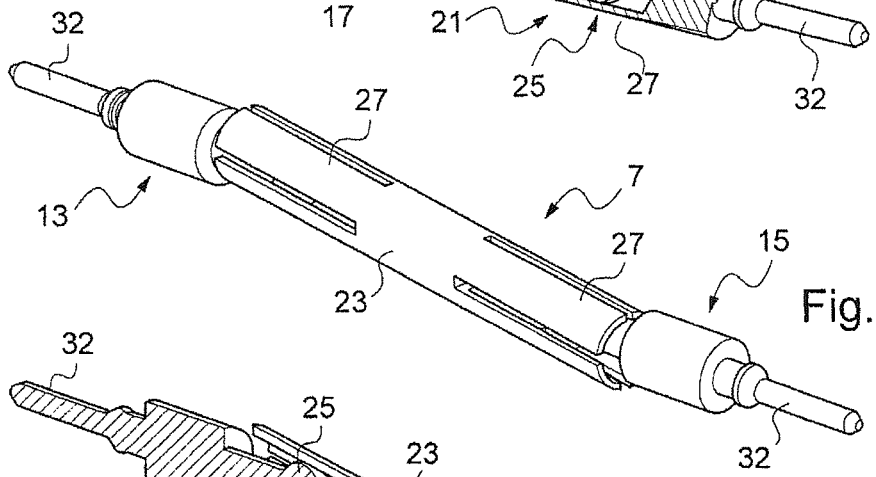
Figure 11:
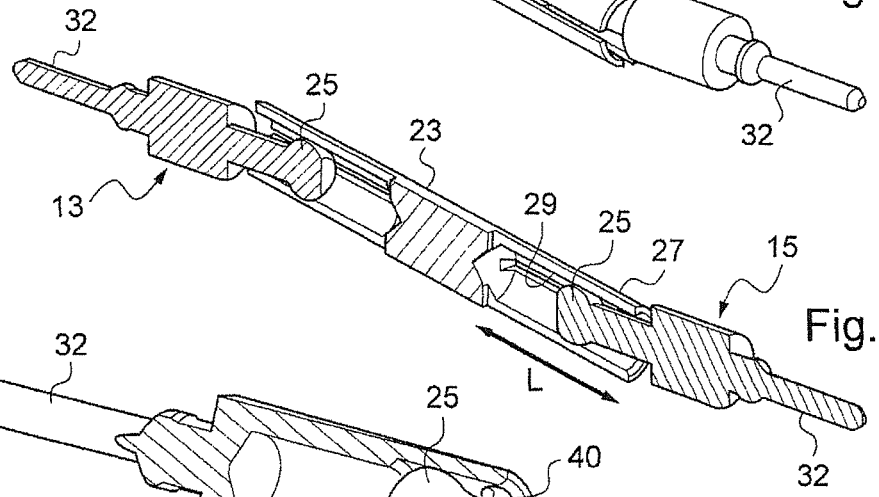
Figure 12:
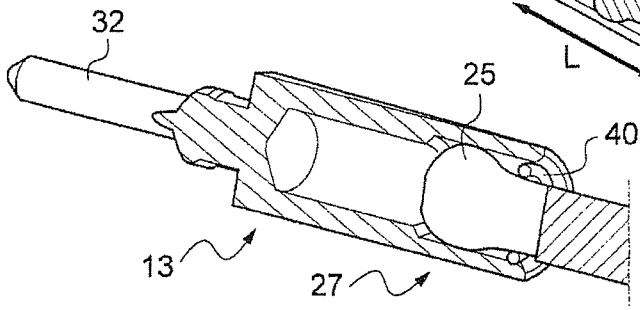

Other characteristics and advantages of the invention will emerge from the following description, given by way of example, without limiting character, with regard to the appended figures in which:

FIG. 1 is a perspective view of a connector according to a first embodiment equipped with connection elements, FIG. 2 shows the connector of FIG. 1 according to a view from above, FIG. 3 shows a detailed perspective view of a connection element of FIG. 1 according to a first embodiment, FIG. 4 shows a longitudinal sectional view of a connection element of FIG. 3, FIG. 5 shows a detailed perspective view of an electrical linking member of FIGS. 3 and 4, FIG. 6 shows a detailed perspective view of a first variant of an electrical linking member, FIG. 7 shows a detailed perspective view of a second variant of an electrical linking member, FIG. 8 shows a detailed perspective view of a second embodiment of a connection element according to the invention, FIG. 9 shows a longitudinal sectional view of a connection element of FIG. 8, FIG. 10 shows a detailed perspective view of a third embodiment of a connection element according to the invention, FIG. 11 shows a longitudinal sectional view of a connection element of FIG. 10, FIG. 12 shows a longitudinal sectional partial view of a connection element according to another variant, FIG. 13 is a perspective view of a connector according to a second embodiment, FIG. 14 shows a perspective view of a block shrouding the electrical linking members of the connection elements of the connector of FIG. 13, FIG. 15 shows a perspective view of a base carrying the electrical contact parts of the connection elements of the connector of FIG. 13, and FIG. 16 illustrates in a schematic manner the various steps of a method for assembling the connector of FIG. 13.

In all the figures, the same elements bear the same reference numbers.

In FIGS. 1 and 2 is represented in perspective and viewed from above an electrical connector 1 for example for connecting a functional board (not represented), for example a printed circuit board (PCB) carrying for example functional units such as radar components, to a junction terminal of a mating connector for example of a rack (not represented).

This electrical connector 1 comprises a first base 3 and a second base 5, made for example of plastic such as polyphenylene sulfide PPS. These bases 3 or 5 may be identical or different depending on the junction terminals that the connector is supposed to join electrically. These bases may be mounted straight or bent on an integrated circuit or on the facade of an outer casing.

The bases 3 and 5 furthermore comprise at their lateral ends drilled ears 9 in which articulated fixings 11, represented schematically in FIG. 2, may be housed. The function of these articulated fixings 11 is to maintain the gap between the bases 3 and 5 in a certain operating span.

These first and second bases 3 and 5 carry respectively ends of connection elements 7 which are represented in a detailed manner in FIGS. 3, 4 and 5. The electrical connection elements 7 are made of metal.

The connection elements 7 according to FIGS. 3, 4 and 5 will now be described in greater detail.

The electrical connection element 7 comprises a first electrical contact part 13 and a second electrical contact part 15 made for example of brass CuZn as well as a rigid electrical linking member 17 made for example of bronze BZ4 or else of copper-beryllium alloy CuBe2, one end of which is linked via a first articulation 19 on the first contact part 13 and the second end of which is linked via a second articulation 21 to the second electrical contact part 15.

These articulations 19 and 21 are effected in the form of a knuckle articulation.

According to the embodiment of FIGS. 1 to 5, the rigid electrical linking member 17 is formed by a rod 23 carrying at each end a knuckle 25 and each electrical contact part 13 and 15 comprises an end in the form of a receptacle 27 receiving an associated knuckle 25.

As seen in FIG. 4, the receptacle 27 exhibits a reception channel 29 for an associated knuckle 25. This channel 29 exhibits a length L allowing a translational movement of the knuckle 25 inside the receptacle 27.

According to one embodiment, not represented, each receptacle 27 can exhibit a constriction at its end for introducing the knuckle 25 so as to serve as stop for an associated knuckle when the latter has been introduced so as to prevent the articulation from being able to come apart.

Moreover, it is seen in FIGS. 4 and 5 that each knuckle 25 is split, preferably along two perpendicular axes. Thus, provision is made for the outer diameter of the unstressed knuckle 25 to be slightly greater than the inside diameter of the receptacle 27 and therefore of the channel 29 so that during the introduction of the knuckle 25 into the channel 29, the knuckle is compressed and the four segments 31 of the knuckle are retained elastically inside the associated receptacle 27 against the internal walls of the channel 29. Thus, it is possible to establish in a safe manner an electrical link between an electrical contact part 13 or 15 and the linking member 17. Moreover, a certain mechanical retention between the parts 13 and 15 and the linking member 17 is also obtained.

Moreover, it is noted in FIGS. 1 to 4 that the end of the electrical contact parts 13 and 15 opposite from the receptacle 27 carries a male plug 32. Of course, a version with female socket is also conceivable. This plug or socket 32 is intended to cooperate with a mating plug or socket of a mating connector, not represented.

Referring to FIG. 1, it is noted that these male plugs 32, or as a variant female sockets, are received in associated complementary housings 33 provided on the bases 3 or 5, so that the latter can carry a plurality of connection elements 7 arranged in parallel to one another in the example illustrated.

In FIG. 5, the electrical linking member 17 possesses a general shape of a bone with a cylindrical central part 35 having nearly the same diameter as the diameter of the knuckles 25. This allows better retention during undercut machining.

In FIG. 6 is represented a variant of the linking member 17 which is distinguished from the version of FIG. 5 by the fact that the central part is of smaller section than the knuckles 25 and possesses a cross section in the form of a square.

In FIG. 7 is represented a variant of the linking member 17 which is distinguished from the version of FIG. 5 by the fact that the rod central part is bent. This arrangement allows the manufacture of bent connectors, for example bent to 90°.

The variant represented in FIGS. 8 and 9 is distinguished from that of FIGS. 3 and 4 by the fact that it is not the knuckles 25 which are split, but the receptacles 27 along their longitudinal axis.

In these figures, it is more clearly apparent that the knuckles 25 can slide inside the receptacle 27.

The embodiment of FIGS. 10 and 11 is distinguished from that of FIGS. 3 and 4 by the fact that the rigid electrical linking member is formed by a rod 23 carrying at each end a receptacle 27 and each electrical contact part 13, 15 comprises an end in the form of a knuckle 25 inserted into an associated receptacle 27.

In this embodiment, the receptacles 27 are split, but provision may also be made for the knuckles to be split as described above without departing from the scope of the present invention.

According to yet another variant represented in FIG. 12, provision may be made to retain the knuckle inside the receptacle by virtue of a clip 40 inserted into the receptacle which exerts an elastic retaining force against the internal wall of the receptacle. This clip can for example be a simple metallic open ring.

According to a variant embodiment of the connector 1 represented in FIG. 13, the gap between the bases 3 and 5 is maintained by a block 41 of an elastic and insulating material which shrouds the electrical linking members 7. This therefore avoids the use of articulated fixings 11 as in the embodiment illustrated in FIG. 2.

The block 41 (FIG. 13) of elastic material is for example made of silicone, preferably by molding. By way of example, the hardness of the silicone is between 40 and 50 Shore.

In this case, the bases 3 and 5 are then fixed on the block 41, for example by gluing with the aid of a silicone glue.

Referring to FIG. 14, it is noted that the block exhibits two housings 43 and 45 for receiving respectively the bases 3 and 5, and orifices 47 for receiving the linking members 17 while leaving their ends free, that is to say that these ends project into the housings 43 and 45 of the block 41 so as to make it possible to link these ends to the first electrical contact parts 13 and to the second electrical contact parts 15 of the bases 3 and 5.

The housings 43 and 45 exhibit a shape complementary to that of the bases 3 and 5. In the example illustrated in FIGS. 14 and 15, the base 3, 5 comprises a substantially parallelepipedal central body and the housing 43, 45 exhibits a cross section of substantially "U"-shaped general form with two lateral walls 49.

According to the embodiment illustrated, the fixing is then effected between the lateral walls 49 of the housing 43, 45 and the lateral walls 51 of the base 3, 5.

For this purpose, it is possible to provide for example a groove (not represented) in the lateral walls 51 of the bases 3, 5 and into which glue is inserted.

Furthermore, such a connector 1 exhibits a smaller height relative to the embodiment illustrated in FIGS. 1 and 2. Indeed, the height of the bases 3, 5 may be decreased relative to the bases of the embodiment of FIGS. 1 and 2, and the block 41 can exhibit a small height, for example of the order of 5 mm.

Moreover, as noted in FIG. 15, the bases 3, 5 comprise respectively two end portions each exhibiting for example an orifice 53 for fixing by screwing onto the mating connector.

Thus, the assembling of such a connector 1 with reference to FIGS. 13 to 16, comprises a first step E1 in which the first electrical contact parts 13 are inserted into the first base 3 and in which the second electrical contact parts 15 are inserted into the second base 5.

During a second step E2, the electrical linking members 17 are inserted into the elastic and insulating material block while leaving the ends of the electrical linking members 17 free, that is to say that first ends project relative to the housing 43 of the block 41 and the second opposite ends project relative to the housing 45 of the block 41.

It is thereafter possible during a step E3 to mount the first base 3 on the block 41 with the first contact parts 13 facing the first ends of the electrical linking members 17 and to link via the first articulations 19 the first ends of the electrical linking members 17 on the first contact parts (13).

In a similar manner, during a step E4 the second base 5 is mounted on the block 41 with the second contact parts 15 facing the second ends of the electrical linking members 17 and the second ends of the electrical linking members 17 are linked via the second articulations 21 on the second contact parts 15.

Finally, in step E5 the bases 3, 5 are fixed on the block 41.

Simple assembly of the connector 1 is thus obtained. Of course, the order of certain steps of this method of assembly may be reversed.

Thus, by virtue of these articulated electrical connection elements, a connector can be produced which makes it possible to alleviate the tolerances and play between for example a PCB board and a rack and their respective connectors.

It is therefore readily understood that the connector presented hereinabove allows fast mounting of a board in a rack while ensuring a certain flexibility.

In a yet more advanced version, the bases are equipped with guidance means cooperating with complementary guidance means of the mating connector so that a sort of self-alignment of the connectors is obtained by virtue of the flexibility of the connector 1.

It makes it possible to circumvent the irksome soldering steps and allows secure retention of the electrical connection.

The invention claimed is:

1. An electrical connector configured to be coupled between a first base and a second base, the electrical connector comprising:

a plurality of electrical connection elements comprising respectively a first electrical contact part and a second electrical contact part and wherein:

each electrical connection element furthermore comprises an electrical linking member having a rigid rod with one end linked via a first articulated joint to the first contact part and another end linked via a second articulated joint to the second electrical contact part, and in that the first electrical contact parts are configured to be retained in a first base and in that the second electrical contact parts are configured to be retained in the second base; and articulated fixings coupled between the first base and the second base.

2. The electrical connector as claimed in claim 1 wherein the plurality of electrical connection elements allow the first and second bases to move in at least three orthogonal directions.

3. The electrical connector as claimed in claim 1, characterized in that the first and second articulations are each provided as a knuckle articulation.

4. The electrical connector as claimed in claim 3, characterized in that the electrical linking member is formed by a rigid rod carrying at each end a knuckle and in that each electrical contact part comprises an end in the form of a receptacle for receiving an associated knuckle.

5. The electrical connector as claimed in claim 4, characterized in that the rod is bent.

6. The electrical connector as claimed in claim 4, characterized in that each receptacle is split so as to exert an elastic retaining force on the associated knuckle.

7. The electrical connector as claimed in claim 4, characterized in that each knuckle is split so as to exert an elastic retaining force inside the associated receptacle.

8. The electrical connector as claimed in claim 4, characterized in that the receptacle is provided having a channel for receiving an associated knuckle, the channel having a length (L) allowing a translational movement of the knuckle inside the receptacle.

9. The electrical connector as claimed in claim 8, characterized in that each receptacle comprises a constriction serving as stop for an associated knuckle.

10. The electrical connector as claimed in claim 8, characterized in that each receptacle comprises a clip for retaining an associated knuckle in the receptacle.

11. The electrical connector as claimed in claim 3, characterized in that the electrical linking member is formed by a rigid rod carrying at each end a receptacle and in that each electrical contact part comprises an end in the form of a knuckle inserted into an associated receptacle.

12. The electrical connector as claimed in claim 1, characterized in that the first or the second electrical contact part comprises a male plug or a female socket.

13. The electrical connector as claimed in claim 1, characterized in that the electrical connector comprises an elastic and insulating material disposed about the electrical linking members so as to shroud the electrical linking members.

14. The electrical connector as claimed in claim 13, characterized in that the elastic and insulating material is made of silicone.

15. The electrical connector as claimed in claim 1, characterized in that the first electrical contact part has one of a male plug or female socket and the second electrical contact part has one of a male plug or female socket, and in that when the electrical connector is fully assembled, the rigid rod is moveable with respect to the first and second electrical contact parts via the first and second articulated joints.

16. The electrical connector as claimed in claim 15, wherein:

each electrical contact part has a receptacle formed therein; and each electrical linking member is formed by a rod carrying at each end thereof a knuckle for cooperating with a receptacle of an associated electrical contact part so as to form the articulated joint which allows relative movement between the electrical linking member and the electrical contact part.

17. The electrical connector as claimed in claim 15, characterized in that the electrical linking member is formed by a rod carrying at each end a receptacle for cooperating with an associated knuckle of an electrical contact part.

18. An electrical connector configured to be coupled between a first base and a second base, the electrical connector comprising:

a plurality of electrical connection elements comprising respectively a first electrical contact part and a second electrical contact part and wherein:

each electrical connection element furthermore comprises an electrical linking member having a rigid rod with one end linked via a first articulated joint to the first contact part and another end linked via a second articulated joint to the second electrical contact part, and in that the first electrical contact parts are configured to be retained in a first base and in that the second electrical contact parts are configured to be retained in the second base;

an elastic and insulating material disposed about the electrical linking members so as to shroud the electrical linking members and characterized in that the bases are respectively fixed to the elastic and insulating material disposed about the electrical linking members.

19. The electrical connector as claimed in claim 18, wherein the elastic and insulating material disposed about the electrical linking members is provided as two housings for receiving respectively an associated base, each of said housings exhibiting a cross section of general "U"-shaped form with two lateral walls , and in that the associated base fixed to the two lateral was of said housing.

20. A method for assembling an electrical connector configured to be coupled between a first base and a second base, the method comprising:

inserting first electrical contact parts into the first base;

inserting second electrical contact parts into the second base;

inserting electrical linking members into an elastic and insulating material block while leaving first and second opposing ends of the electrical linking members free wherein each electrical linking member has a rigid rod with one end linked via a first articulated joint to the first contact part and another end linked via a second articulated joint to the second electrical contact part, and in that the first electrical contact parts are configured to be retained in the first base and in that the second electrical contact parts are configured to be retained in the second base;

mounting the first base on said block with the first contact parts facing first ends of the electrical linking members;

linking the first ends of the electrical linking members to the first contact parts with a first articulated joint;

mounting the second base on said block with the second contact parts facing the second ends of the electrical linking members;

linking the second ends of the electrical linking members to the second contact parts with a second articulated joint wherein the first and second articulated joints allow the first and second bases to move in at least three orthogonal directions;

securing the bases on said block; and coupling articulated fixings between the first base and the second base.

21. An electrical connector for making electrical connections between a first base and a second base, the electrical connector comprising:

a plurality of articulated electrical connection elements, each of said plurality of articulated electrical connection elements comprising:

a first electrical contact part having a first end configured to be coupled to the first base and a second end, said first electrical contact part comprising a first receptacle haying an opening therein;

a second electrical contact part having a first end configured to be coupled to the second base and a second end, said second electrical contact part comprising a second receptacle having an opening therein;

an electrical linking member having a rigid rod having first and second opposing ends with the first end of said rigid rod having one end linked via a first articulated joint to the first contact art and another end linked via a second articulated joint to the second electrical contact part, with the first end of said rigid rod having a first knuckle having a size and shape selected to fit into the opening of said first receptacle so as to form the first articulated joint which allows relative movement between said rigid rod and the second end of said first electrical contact when the electrical connector is fully assembled and with the second end of said rigid rod having a second knuckle having a size and shape selected to fit into the opening of said second receptacle so as to form the second articulated joint which allows relative movement between said rigid rod and the second end of said second electrical contact when the electrical connector is fully assembled and wherein each of the first and second receptacles is provided having a channel for receiving a respective one of said first and second knuckles, with each of the channels having a length selected to allow a translational movement of the respective first and second knuckles inside the opening of the respective one of the first and second receptacles and wherein the first and second articulated joints allow the first and second bases to move hi at least three orthogonal directions when the electrical connector is fully assembled; and articulated fixing a coupled between the first base and the second base.

22. The electrical connector of claim 21 wherein each receptacle is split so as to exert an elastic retaining force on the associated knuckle.

23. The electrical connector of claim 21 wherein each receptacle is split along first and second orthogonal planes so as to exert an elastic retaining force on the associated knuckle.

24. The electrical connector of claim 21 wherein each knuckle is split so as to exert an elastic retaining force inside the associated receptacle.

25. The electrical connector of claim 21 wherein each knuckle is split along first and second orthogonal planes so as to exert an elastic retaining force inside the associated receptacle.

26. An apparatus comprising:

a first base having a first plurality of receptacles;

a second base having a second plurality of receptacles;

a plurality of articulated electrical connection dements, each of said plurality of articulated electrical connection elements disposed to provide an electrical connection between at least one of the first plurality of receptacles in said first base and at least one of the second plurality of receptacles in on said second base, and each of said plurality of articulated electrical connection elements comprising:

a first electrical contact part having a first end configured to be coupled to said first base and a second end;

a second electrical contact part having a first end configured to be coupled to the second base and a second end; and a rigid rod having a first end movably coupled to the second end of said first electrical contact part and having a second, opposite end movably coupled to the second end of said second electrical contact part and wherein said rigid rod is movably coupled to the first and second end of said first electrical contact part when the electrical connector is fully assembled; and first and second articulated fixings each having a first end coupled to said first base and a second end coupled to said second base, said first and second articulated fixings coupled between said first and second bases to maintain a spacing between said first and second bases within a predetermined range and allow the first and second bases to move in at least three orthogonal directions.

* * * * *